United States Patent [19]

Odawara

[11] Patent Number: 4,509,900

[45] Date of Patent: Apr. 9, 1985

[54] TURBINE ROTOR

[75] Inventor: Masachika Odawara, Yokohama, Japan

[73] Assignee: Tokyo Shibaura Denki Kabushiki Kaisha, Kawasaki, Japan

[21] Appl. No.: 542,216

[22] Filed: Oct. 14, 1983

[30] Foreign Application Priority Data

Oct. 14, 1982 [JP] Japan ..... 57-180376
Jan. 25, 1983 [JP] Japan ..... 58-11119

[51] Int. Cl.[3] ..... F01D 5/06
[52] U.S. Cl. ..... 416/198 A; 416/201 R
[58] Field of Search ..... 416/198 A, 204 A, 201 R, 416/201 A, 200 A, 199; 415/199.4, 199.5

[56] References Cited

U.S. PATENT DOCUMENTS

| | | | |
|---|---|---|---|
| 1,107,238 | 8/1914 | Kieser | 416/198 A |
| 2,497,151 | 2/1950 | Clark et al. | 416/201 |
| 3,070,348 | 12/1962 | Vogel | 416/198 A |
| 4,029,437 | 6/1977 | Aubry et al. | 416/198 A |
| 4,330,236 | 5/1982 | Le Breton | 416/199 X |

FOREIGN PATENT DOCUMENTS

| | | | |
|---|---|---|---|
| 576536 | 5/1959 | Canada | 416/198 A |
| 513004 | 6/1932 | Fed. Rep. of Germany | 416/198 |
| 85205 | 7/1978 | Japan | 416/212 A |
| 41403 | 3/1982 | Japan | 416/198 A |
| 219655 | 10/1924 | United Kingdom | 416/198 A |

OTHER PUBLICATIONS

Proceedings 1979, vol. 193, No. 11, p. 98—FIG. 6, UK Experience of Stress Corrosion Cracking in Steam Turbine Discs.

*Primary Examiner*—Everette A. Powell, Jr.
*Attorney, Agent, or Firm*—Oblon, Fisher, Spivak, McClelland & Maier

[57] ABSTRACT

A turbine rotor has a shaft, a plurality of wheel discs shrunk-fit on said shaft along the axial direction thereof, said wheel discs being provided with blades on the outer circumference thereof. A plurality of coupling members are disposed between the wheel discs except the ones disposed most downstream, for coupling the wheel discs to each other. At least one coupling means is disposed between the wheel disc disposed most downstream of the shaft.

5 Claims, 9 Drawing Figures

TURBINE ROTOR

BACKGROUND OF THE INVENTION

1. Field of the Invention

This invention relates to a turbine rotor.

2. Description of the Prior Art

In general, a low pressure turbine rotor, or the like, of a large scale steam turbine for driving an electric generator is provided with a plurality of blades which are larger in average diameter than in a high-pressure turbine so as to permit the flow of a large quantity of steam.

In such a huge turbine rotor, to solve problems both in manufacturing techniques and in production economics, there have been developed so-called shrink-fit (or shrunk-on) wheel discs in which the wheel discs to which the blades of respective stages are fitted are previously manufactured separately from the rotor shaft, and thereafter the wheel discs are heated so as to be fitted onto the rotor shaft by shrink fitting.

FIG. 1 illustrates a conventional steam turbine rotor provided with such shrink fit wheel discs. Reference numeral 1 represents a shaft of the turbine rotor. A plurality of shrink-fit wheel discs 3 which are provided with blades 2 on the outer circumference thereof are fitted to the shaft 1 along the axial direction thereof and held with wheel bore keys 4.

There are also installed locking keys 5 which restrain the axial movement of the wheel discs 3.

In the turbine rotor having such a structure, steam energy is converted into torque by means of blades 2, and thereafter is transmitted to the wheel discs 3. The torque transmission from the wheel discs 3 to the shaft 1 is achieved by virtue of friction delivered from the facing pressure of the shrink-fit faces of the wheel discs 3 and the wheel bore keys 4.

In such a turbine rotor, the stage which is nearest the steam inlet side is subjected to relatively higher pressure and temperature. The wheel disc 3 of this stage, with a small heat capacity, is heated faster, by an amount depending upon the operation status thereof, than the shaft 1 so that temperature differences occur between this and adjacent wheel discs 3 and the shaft 1, and this may possibly cause the wheel discs 3 to become loosened. If the wheel discs 3 are loosened, the torque transmission is entirely through the wheel bore keys 4. At the same time, the shrink-fit faces on the inner surfaces of the wheel discs 3 retain some constant facing pressure against the shaft 1 and also maintain a uniform inner face tangential stress.

In the turbine rotor with the above-described structure, on the inner faces of the wheel discs 3 wheel bore key ways 6 are disposed so as to fit the wheel bore keys 4, and stress concentration occurs in the vicinity of the wheel bore key ways 6. As a result, there are dangers of developing stress corrosion cracks (SCC) as indicated by numeral 7 in the vicinity of the wheel bore key ways 6 as shown in FIG. 2. In particular, the wheel discs 3 which are exposed to an atmosphere having temperatures of approximately 130° to 150° C. inevitably develop high stress concentrations, so that the wheel bore key ways 6 are in danger of developing stress corrosion cracking.

SUMMARY OF THE INVENTION

Accordingly, one object of this invention is to provide a turbine rotor capable of eliminating the danger of developing stress corrosion cracking on wheel bore key ways of the wheel discs, and also capable of assuring torque transmission between the wheel discs and the shaft.

To achieve this object, there is provided a turbine rotor having a shaft with a plurality of wheel discs shrunk on the shaft along the axial direction thereof. The wheel discs are provided with blades on the outer circumference thereof. A plurality of coupling members are disposed between the wheel discs, except the ones disposed most downstream, for coupling the wheel discs to each other, and at least one coupling means is disposed between the wheel disc disposed most downstream and the shaft.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
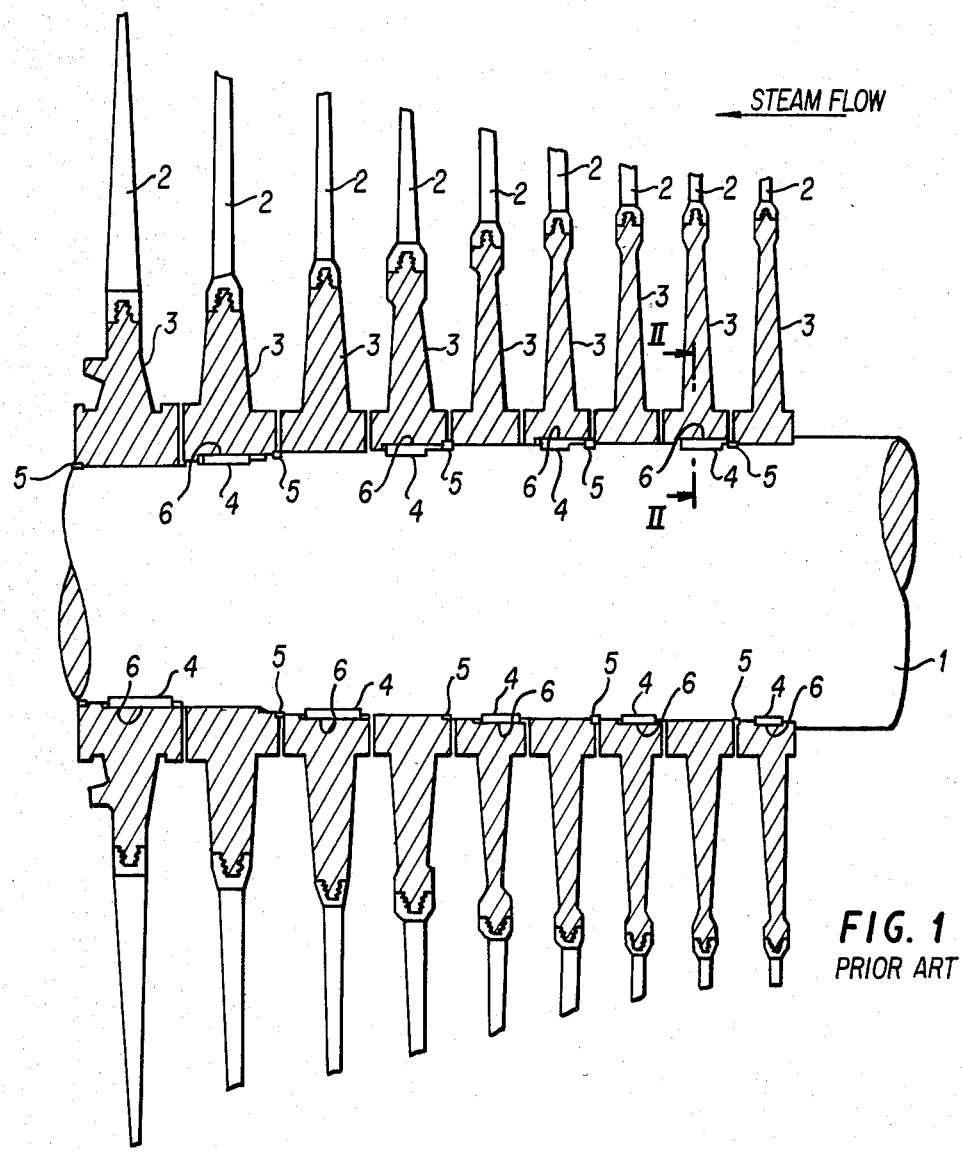
FIG. 1 PRIOR ART
FIG. 1 is a longitudinal sectional diagram illustrating the conventional turbine rotor.
Figure 2:
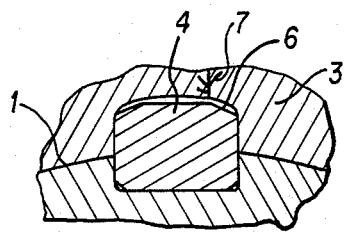
FIG. 2 PRIOR ART
FIG. 2 is a transverse sectional diagram illustrating one example of stress corrosion cracks developed on wheel bore key way portions of FIG. 1.
Figure 3:
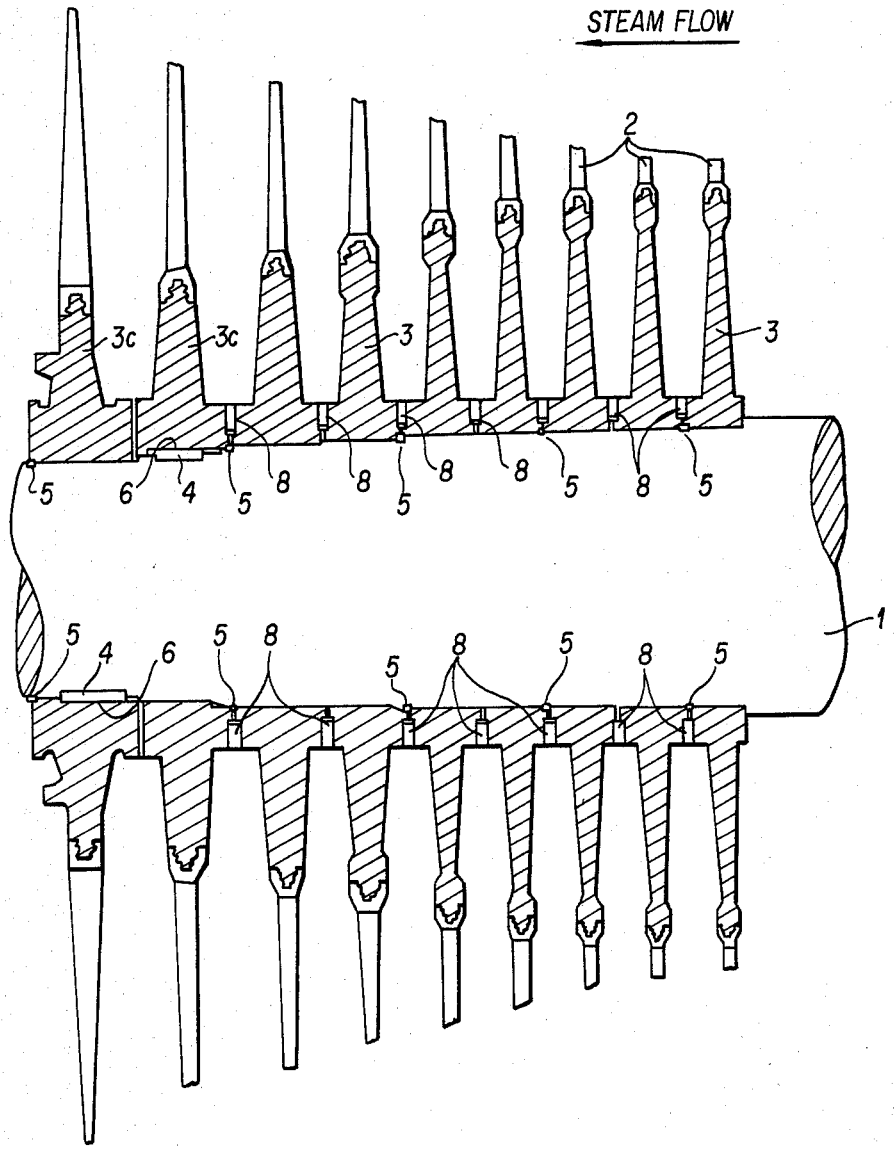
FIG. 3 is a longitudinal sectional diagram illustrating a turbine rotor of one embodiment according to the present invention.

Referring now to the drawings, wherein like reference numerals designate identical or corresponding parts throughout the several views, and more particularly to FIG. 3, reference numeral 1 represents a shaft of the turbine rotor. A plurality of wheel discs 3 provided with blades 2 fitted on the outer circumference therof are fitted in shrink-fit manner to the shaft 1 along the axial direction thereof. The wheel discs 3 positioned at the upstream side of the turbine rotor transmit torque to adjacent wheel discs 3. That is, the wheel discs are connected to each other by connecting members such as wheel radial keys 8.

Wheel discs 3C disposed at the downstream side of the turbine rotor are, in the same manner as in the conventional turbine rotor, provided with wheel bore key ways 6 to which wheel bore keys are inserted.

Figure 4:
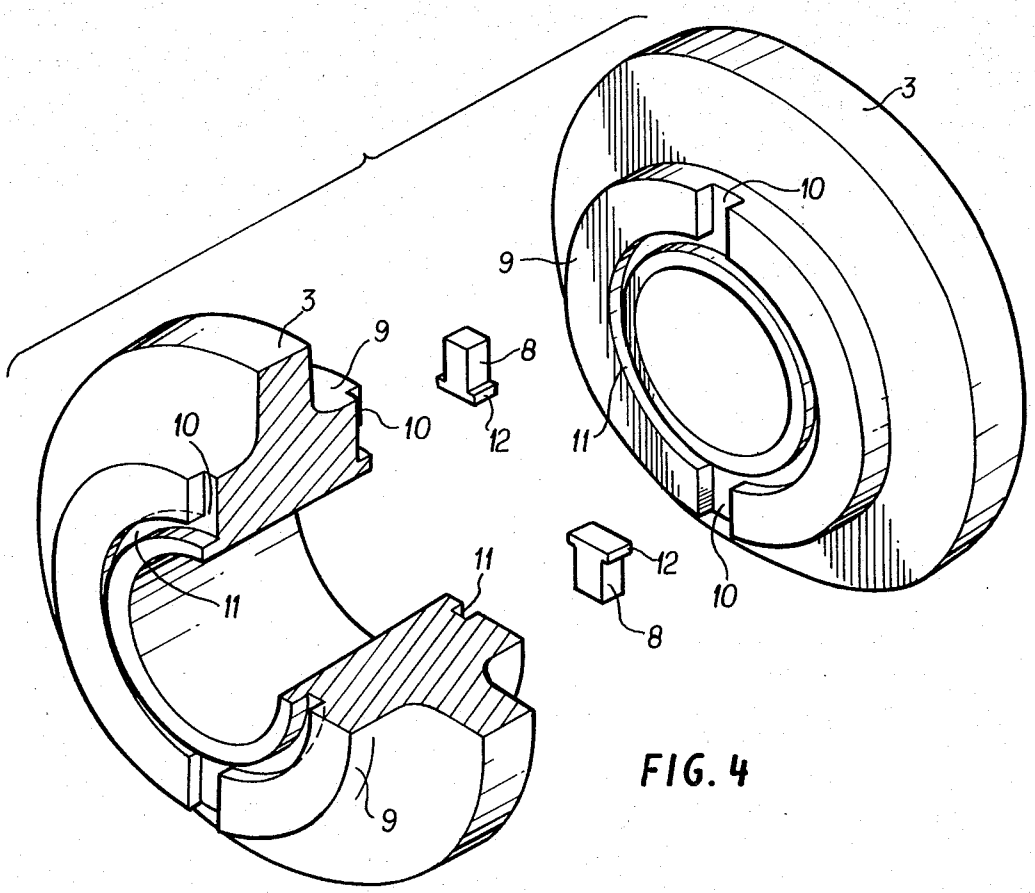
FIG. 4 is an enlarged perspective diagram illustrating the wheel discs shown in FIG. 3.

Referring to FIG. 4, showing an enlarged detail of the wheel discs 3 shown in FIG. 3, with the outer circumference of the wheel discs 3 to be provided with blades 2 omitted, on both sides of hub portions 9 of the wheel disc 3, there are formed wheel radial key ways 10 extending in the radial direction and circumferentially spaced by an angle of 180°. Also formed thereon are annular stress relaxation grooves 11 in contact with the radially inner ends of the wheel radial key ways 10. Into the wheel radial key ways 10 of the wheel disc 3, there are inserted rectangular prism-shaped wheel radial keys 8, on one end of which there are provided holding members 12 consisting of projections. The holding members 12 are inserted into the stress relaxation groove 11 so as to prevent the keys 8 from being pulled out by centrifugal force caused by rotation of the turbine rotor. The number of the wheel radial keys 8 to be installed is determined depending upon the amount of torque to be transmitted by the wheel discs 3, so that the number thereof varies from one to many.

In the turbine rotor with the above-described structure, torque from the wheel discs 3 is transmitted, during normal operations, to the shaft 1 by virtue of friction force caused by facing pressure of the shrink-fit face of the wheel discs 3.

On the other hand, when the wheel discs 3, with small heat capacity, are heated faster than the shaft 1 and the wheel discs 3 near the steam inlet side are loosened, the torque imposed on the loosened wheel discs 3 is transmitted to the shaft 1 through the adjacent wheel discs 3.

In the case when all the wheel discs at the upstream side are loosened, so that torque can no longer be transmitted directly to the shaft 1, the torque is transmitted to the shaft 1 through the most downstream wheel discs 3C which are stopped against the shaft 1 by the wheel bore keys 4.

In the turbine rotor with such a structure, the wheel bore key ways 6 which are conventionally formed on the inner faces of the wheel discs 3 disposed at the steam inlet side can be eliminated, so that stress corrosion cracks which have previously developed can be avoided.

In such a turbine rotor, the wheel radial key ways 10 are formed on the side faces of the hub portion 9 of the wheel discs 3. However, since relatively lower stress exists at these side faces, the wheel radial key ways 10 are in relatively less danger of developing stress corrosion cracks.

The wheel discs 3C positioned at the most downstream end of the shaft are stopped against the shaft 1 by the wheel bore keys 4. However, the wheel discs 3C are, as described above, in relatively less danger of developing stress corrosion cracks even when stress concentrations are developed, so that the same structure as in the conventional turbine rotor is sufficient for adequate reliability. Further, corrosion caused by steam, which can develop on the side faces of the hub portion 9 due to the conventional wheel bore key ways 6 can be eliminated.

Figure 5:
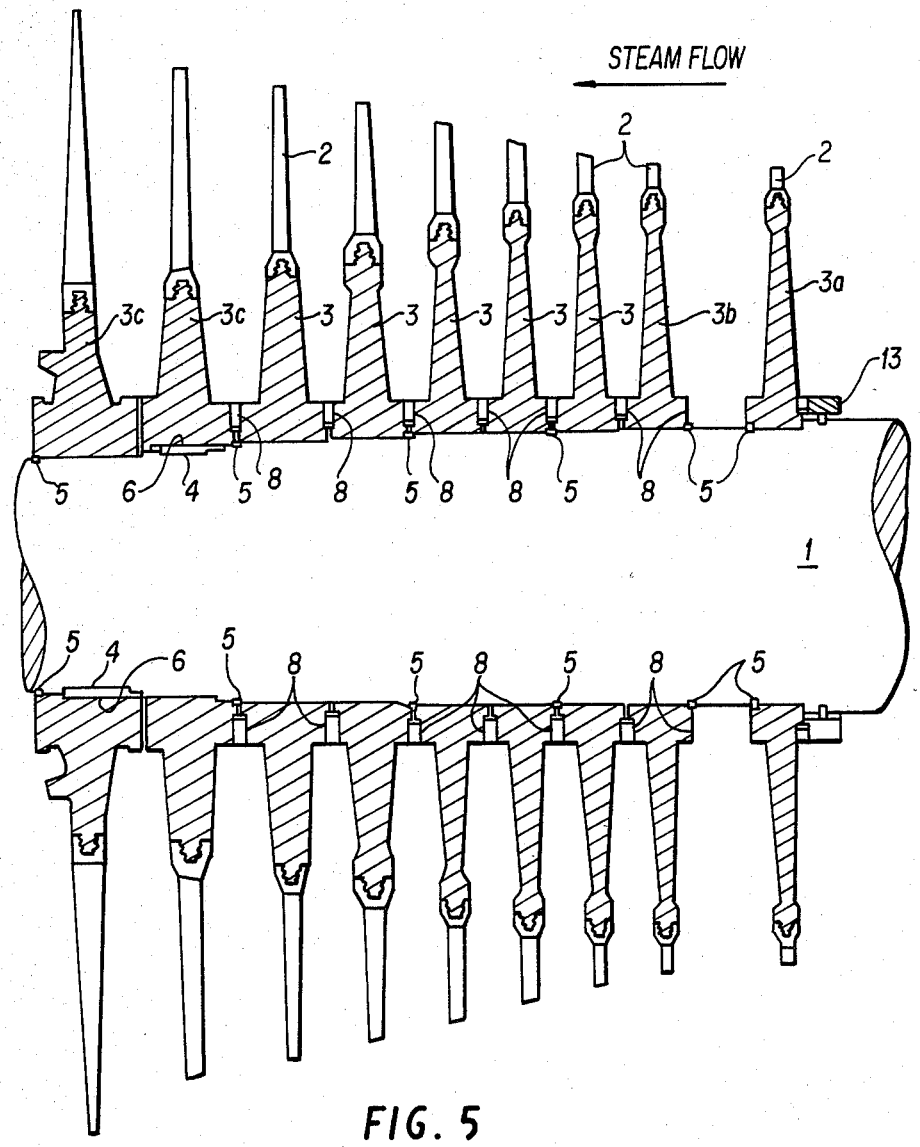
FIG. 5 is a longitudinal sectional diagram illustrating a turbine rotor of another embodiment according to the present invention.

Referring to FIG. 5, illustrating another embodiment of a turbine rotor according to the present invention, reference numeral 1 again represents a shaft of the turbine rotor. A plurality of wheel discs 3 provided with blades 2 are fitted on the outer circumferences thereof in a shrink-fit manner along the axial direction of the shaft 1.

A wheel disc **3*a* which is positioned at the most upstream side (steam inlet side) of the turbine rotor is spaced by a large axial gap from a wheel disc 3*b* adjacent thereto on the downstream side (steam outlet side) of the wheel disc 3*a*. A large surface area of the shaft 1 is thus exposed between the wheel discs 3*a* and 3*b*. The wheel discs 3 which are positioned at the downstream side with respect to the wheel disc 3*b*** are successively mutually spaced by minute gaps in the same manner as in the first embodiment.

The wheel discs 3 and the wheel disc **3*b* which is disposed adjacent to the wheel disc 3*a* positioned at the most upstream side of the turbine rotor 1 are connected to one another by connecting members such as the wheel radial keys 8** for transmitting torque among the wheel discs.

On wheel discs **3*c* disposed at the downstream side of the turbine rotor, there are provided wheel key ways 6 in the same manner as in the conventional turbine rotors, and wheel bore keys 4 are inserted into the wheel key ways 6**.

The wheel disc **3*a* positioned at the most upstream side of the turbine rotor is connected to a torque ring 13 that transmits torque to the shaft 1**.

Figure 6:
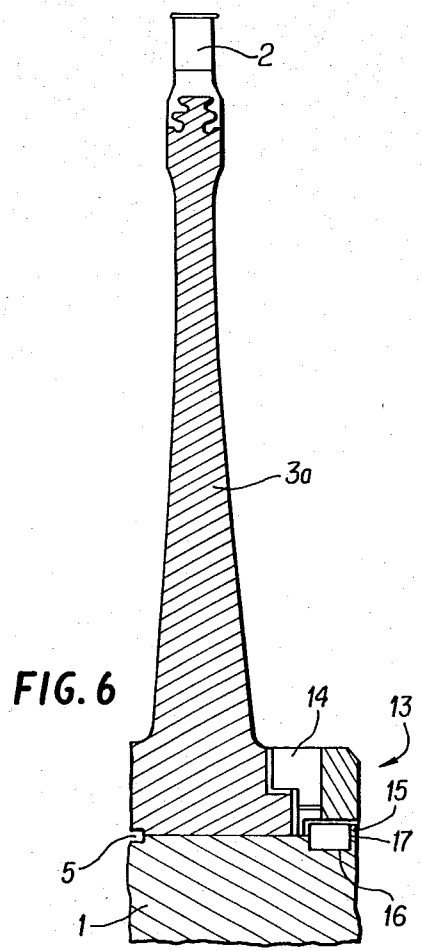
FIG. 6 is an enlarged longitudinal sectional diagram illustrating wheel discs and torque rings shown in FIG. 5.
Figure 7A:
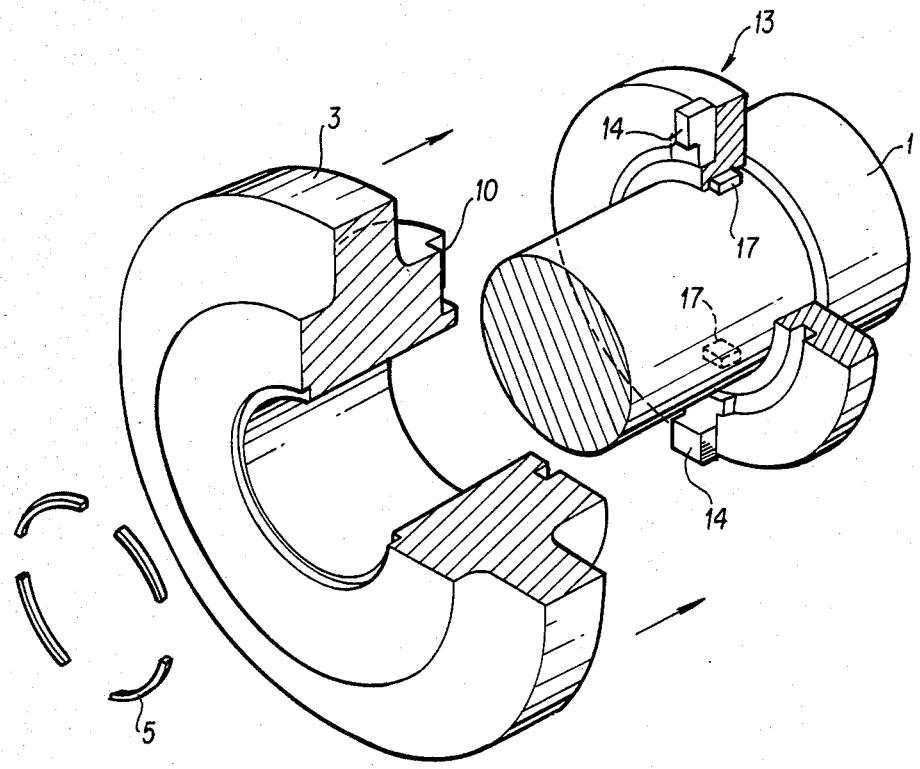
FIGS. 7A and 7B are perspective diagrams of the embodiment shown in FIG. 6.
Figure 7B:
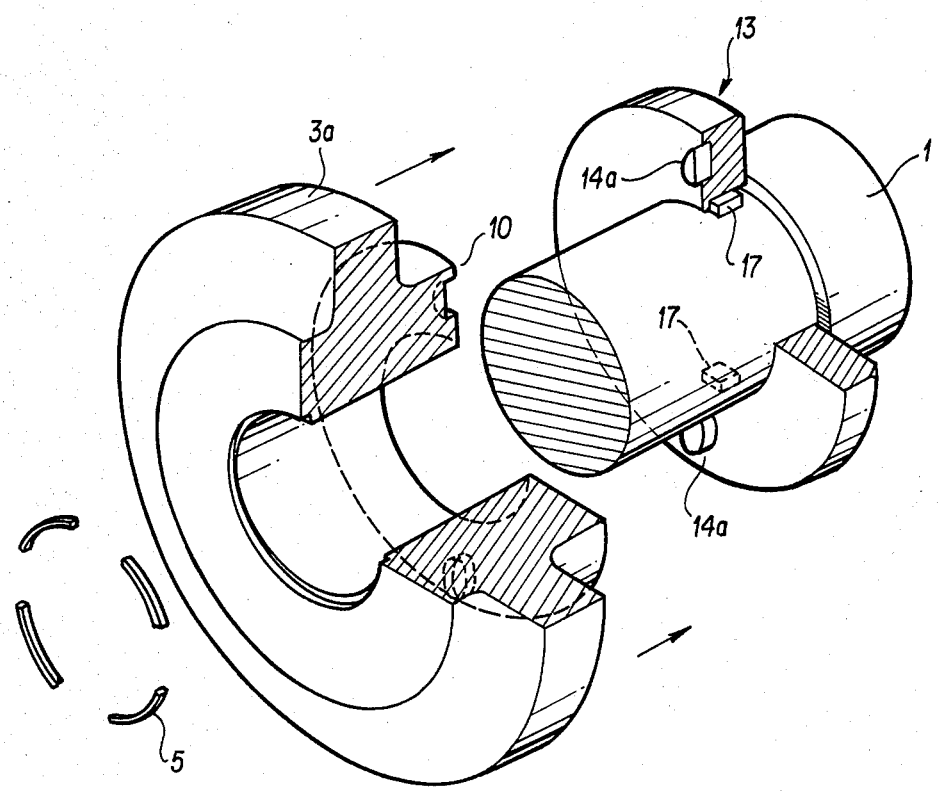

Referring to FIGS. 6, 7A and 7B, the enlarged details of the wheel disc **3*a* and the torque ring 13 shown in FIG. 5, are illustrated. On the sides of the wheel disc 3, there are formed two wheel key ways 10 mutually spaced along the circumferential direction by an angle of 180°. A cylindrical torque ring 13 is shrunk fit on the shaft 1 adjacent to the wheel disc 3*a*, and on the side of the torque ring 13 there are formed torque ring radial keys 14 to be inserted into the wheel key ways 10 of the wheel disc 3. The keys 14 are formed together with the torque ring 13 in monobloc structure. Two torque ring bore key ways 15 are formed on the inner circumferential face of the torque ring 13 and are mutually spaced by an angle of 180°. Although the torque ring keys 14 in FIG. 7A are formed in the same manner as the wheel radial keys 8, in FIG. 7B round keys 14*a* are mounted on side of torque ring 13**.

At respective positions corresponding to the torque ring bore key ways 15 of the shaft 1, there are also formed key ways 16, and the torque ring bore keys 17 are inserted into the space formed between the key ways 16 and the torque ring bore keys 15. Reference numeral 5 represents locking keys to restrain the axial movement of the wheel disc **3*a***.

In the turbine rotor with the above-described structure, torque from the wheel discs **3*a*, 3*b*, 3 and 3*c* is transmitted, under normal operating conditions, to the shaft 1 by friction derived from facing pressure of the shrink-fit faces of the wheel discs 3*a*, 3*b*, 3 and 3*c***.

Further, since there is provided a large gap between the wheel discs **3*a* and 3*b*, the surface of the shaft therebetween is directly heated, so that the temperature difference between the wheel discs 3*a* and 3*b* and the shaft 1 can be reduced. As a result, disadvantages of the prior art such as when the conventional wheel discs 3*a* and 3*b* with small heat capacity are heated faster than the shaft 1** so that the shrink-fit faces thereof are loosened, can be largely prevented.

However, if the wheel disc **3*b* is loosened, the torque imposed on the loosened wheel disc 3*b* is transmitted through the adjacent wheel discs 3 to the shaft 1. Moreover, when all the wheel discs 3 of the upstream side are loosened and torque can no longer be transmitted directly to the shaft 1, the torque is instead transmitted to the shaft 1 through the wheel discs 3C which are installed at the most downstream side and stopped against the shaft 1 by the wheel bore keys 4**.

On the other hand, when the most upstream wheel disc **3*a* is loosened, the torque of the wheel disc 3*a* is transmitted, through the torque ring keys 14, formed as a monobloc with the torque ring 13, to the torque ring bore key 17, through which the torque, in turn, is transmitted to the shaft 1**.

In the turbine rotor with the above-described structure, the torque ring 13 is, compared with the wheel disc 3*a*, smaller in the outer diameter and weight, so that the effect of centrifugal force is extremely small. Consequently, the reduction in facing pressure of the shrink-fit faces of the torque ring 13 can also be extremely small.

Therefore, the inner face tangential stress of the torque ring 13 is extremely small, as are the stress concentrations developed at the torque ring bore key ways 15, so that there is no longer any danger of developing stress corrosion cracks on the torque ring bore key ways 15.

Moreover, in the turbine rotor with the above-described structure, the wheel bore key ways 6 which have conventionally been formed on the inner circumferential faces of the wheel discs disposed on the steam inlet side can be eliminated, so that problem of stress corrosion cracks developed hitherto on these portions can be solved.

Further, in the turbine rotor with the above-described structure, although the wheel radial key ways 10 are formed on the sides of the hub portions 9 of the wheel discs 3, relatively lower stress occurs on these portions, so that there can be relatively less possibility of developing stress corrosion cracks on the wheel radial key ways 10.

The wheel discs 3C disposed most downstream of the wheel discs are stopped against the shaft 1 by the conventional wheel bore keys 4. However, the same structure as in the conventional turbine rotor is sufficient in strength there because even when stress concentrations are developed on the wheel disc 3C, as described above, there is relatively less possibility of developing stress corrosion cracks. Further, in the turbine rotor with such a structure, corrosion caused by steam, which has conventionally developed from the wheel bore key ways 6 and produced on the side face of the hub portion 9, can be eliminated.

The shrink-fit allowances of the wheel discs 3*a*, 3*b*, 3 and 3*c* and the shaft 1 are usually determined taking into consideration external forces such as centrifugal forces and expansion differences derived from the temperature differences occuring during the normal operation. During such normal operation, torque transmission is performed by virtue of friction between the wheel discs 3*a*, 3*b*, 3 and 3*c* and the shaft 1. However, according to the present invention, the surface of the shaft 1 is directly heated so as to reduce such temprature differences between the wheel discs 3*a* and 3*b* and the shaft 1, so that for the specified shrink-fit allowance, the shrink-fit allowance based upon an expansion difference due to such a temperature difference can be reduced. As a result, the facing pressure and tangential stress of the inner faces of the wheel discs 3*a* and 3*b* can be reduced. According to the present invention, the wheel bore key ways which are formed on the inner circumferential faces of the wheel discs positioned at the steam inlet side, which are conventionally in danger of developing stress corrosion cracks can be eliminated, so that turbine rotors highly reliable and free from developing stress corrosion cracks can be achieved.

Moreover, according to the present invention, there can be provided a highly reliable turbine rotor capable of minimizing the temperature differences between the wheel discs and the shaft so as to prevent looseness therebetween, of performing torque transmission therebetween, and also of eliminating the possibility of developing stress corrosion cracks on the wheel bore key ways of the wheel discs.

Figure 8:
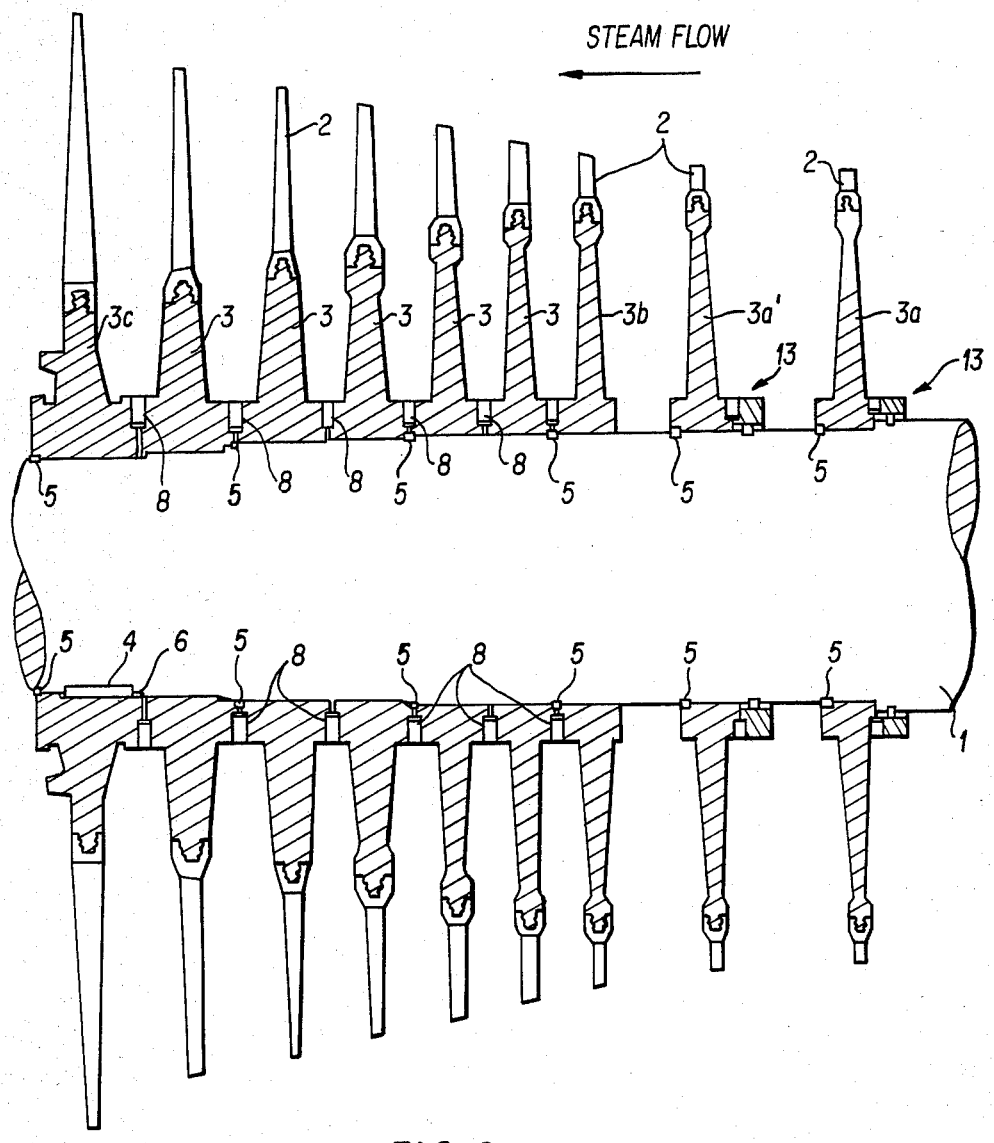
FIG. 8 is a longitudinal sectional diagram illustrating still another embodiment of a turbine rotor according to the present invention.

In the aforementioned embodiments, there are described examples in which most upstream wheel disc 3*a* is formed as a single stage, and the gap between the wheel discs 3*a* and 3*b* is sufficiently enlarged so as to expose the surface of the shaft 1. However, the present invention is not limited to such an embodiment. For example, as shown in FIG. 8, it is also possible, if necessary, to form several stages at the most upstream end of the shaft as respective single stages so as to expose the surface of the shaft 1 therebetween. Namely, in FIG. 8, a wheel disc 3*a* and a wheel disc 3'*a* disposed adjacent thereto are formed as respective single stages, and the gaps between the wheel discs 3*a* and 3'*a* and between the wheel discs 3'*a* and 3*b* are enlarged, and they are respectively coupled to a torque ring 13 on the side. In the turbine rotor with such a structure, the temperature differences between the wheel discs and the shaft are more effectively reduced than those of the turbine rotor of the embodiment shown in FIG. 5.

Moreover, in FIG. 8, only the most downstream wheel disc 3C is coupled against the shaft 1 by a wheel bore key 4.

In FIGS. 3, 5 and 8 round keys 14*a* shown in FIG. 7B can replace the wheel radial keys 8.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a turbine having a fluid flow, a turbine rotor comprising:

a shaft;

a plurality of wheel discs shrunk-fit on said shaft along the axial direction thereof, said wheel discs being provided with blades on the outer circumference thereof;

a plurality of first coupling members disposed between each of first wheel discs defined by at least the upsteam ones of said wheel discs for coupling said wheel discs to each other, and at least one second coupling member disposed between at least one second wheel disc disposed at the downstream end of said shaft and said shaft.

2. The turbine rotor as recited in claim 1, wherein said first wheel discs each include a hub member with a wheel radial key way on the side of said first wheel disc; and said first coupling member includes a wheel radial key to be coupled with said wheel radial key way.

3. The turbine rotor as recited in claim 1, which further comprises an additional wheel disc axially spaced from said first wheel discs in said upstream direction and shrunk-fit on said shaft, said additional wheel disc having a hub member with a key way on the side thereof, and a stopping means arranged adjacent to said additional wheel disc and shrunk-fit on said shaft, said stopping means including a third key adapted to coupled with said key way of said additional wheel disc and a bore key mounted between said stopping means and said shaft.

4. The turbine rotor as recited in claim 3, including a disc bore key positioned between said additional wheel disc and said shaft for restraining the axial movement of said additional wheel disc.

5. The turbin rotor as recited in claim 2, wherein said hub members each include a annular groove, and each said wheel radial key has a projection portion on an inner end thereof for fitting into said annular groove.

* * * * *